United States Patent [19]

Mirzadeh et al.

[11] Patent Number: 4,681,727

[45] Date of Patent: Jul. 21, 1987

[54] PROCESS FOR PRODUCING ASTATINE-211 FOR RADIOPHARMACEUTICAL USE

[75] Inventors: Saed Mirzadeh, East Setauket; Richard M. Lambrecht, Quogue, both of N.Y.

[73] Assignee: The United States of America as represented by the United States Department of Energy, Washington, D.C.

[21] Appl. No.: 598,624

[22] Filed: Apr. 10, 1984

[51] Int. Cl.[4] ..... G21G 1/10

[52] U.S. Cl. ..... 376/198; 376/202; 423/249

[58] Field of Search ..... 376/196, 198, 190, 192, 376/202; 423/249

[56] References Cited

U.S. PATENT DOCUMENTS

| | | | |
|---|---|---|---|
| 3,694,313 | 9/1972 | Blue et al. | 376/198 |
| 3,966,547 | 6/1976 | Blue | 376/195 |
| 4,106,982 | 8/1978 | Christman et al. | 376/195 |

OTHER PUBLICATIONS

Radiopharmaceuticals & Labelled Compounds, vol. 1, IAEA, Vienna, 1973, pp. 303–315, Lindner et al.

Nuclear Instruments & Methods, vol. 109, No. 3, Jun. 1973, pp. 561–563, Woodburn et al.

Int. J. of Applied Rad. & Isotopes, Nov. 1976, No. 11, pp. 597–603, Cuninghame et al.

Int. J. of Applied Rad. & Isotopes, vol. 31, 1980, pp. 163–167, Adilbish et al.

J. of Nuclear Medicine, vol. 14, No. 5, pp. 269–273.

Radiochem. Radioanal. Lett., vol. 25, No. 5–6, 1976, pp. 377–390, Meyer et al.

Int. J. of Applied Rad. & Isotopes, vol. 32, Aug. 1981, No. 8, pp. 581–587, Michael et al.

BNL-32570, 1983, Milius et al., Abstract "Synthesis of Radiopharmaceuticals Specifically Labelled with Astatine—211".

BNL-32690, 1983, Bloomer et al., "Therapeutic Applications of Alpha Emitting Radionuclides".

J. of Radioanalytical Chemistry, vol. 21, (1974), pp. 199–209, Rossler et al.

*Primary Examiner*—Harvey E. Behrend

*Attorney, Agent, or Firm*—Vale P. Myles; James W. Weinberger; Judson R. Hightower

[57] ABSTRACT

A process for reliably and consistently producing astatine-211 in small controlled volumes of a solution, which is selected from a choice of solvents that are useful in selected radiopharmaceutical procedures in which the At-211 activities are to be applied.

5 Claims, 5 Drawing Figures

PROCESS FOR PRODUCING ASTATINE-211 FOR RADIOPHARMACEUTICAL USE

The U.S. Government has rights in this invention pursuant to Contract Number DE-AC02-76CH00016, between the U.S. Department of Energy and Associated Universities Inc.

BACKGROUND OF THE INVENTION

The invention relates to processes for the commercially practical production of radiopharmaceutical activities and, more particularly, relates to a process for the production of astatine-211 (At-211).

For about the last forty years, there has been an interest in exploring the potential of At-211 for therapeutic biomedical applications. At-211 decay results in nearly pure alpha particle emissions. The radiotoxicity associated with such alpha particle emissions and the associated emissions resulting from the decay of its daughter, polonium-211 (Po-211), which has a half-life of only about 0.56 seconds, led to early recognition of the potential for such beneficial therapeutic applications.

At-211 has a half-life of 7.21 hours, which is sufficiently long to enable its practical production, chemical synthesis, transportation, quality control and appropriate biological application in a number of useful radiopharmaceutical treatments of certain diseases. Heretofore, research and development work relating to such radiopharmaceutical treatment procedures has largely focused on the preparation and in vivo evaluation of labelled antibodies, proteins, drugs and inorganic colloids. Such research has usually concentrated on the production of At-211 as a source of Astatine for studies of the physical and chemical properties of the element.

In addition to the interest generated by the established and potential uses of At-211 in therapeutic radiopharmaceuticals, increasing attention is being received by At-211 due to its potential use in radiation synovectomy and for fundamental studies in cell biology. It has been demonstrated, for example, that At-211 Tellurium-colloid can be curative, without undue toxicity, in mice bearing Ascites tumor cells. Among currently available alpha particle emitters, At-211 is particularly promising for radiopharmaceutical therapeutic uses, because it decays by a double branched pathway into lead (Pb-207), directly by alpha emission, and indirectly through electron capture into polonium (Po-211), which in turn decays almost spontaneously by alpha emission.

In the past, radiochemical separation of At-211 has been found to be generally unreliable due to the low and variable recovery yields attainable with such processes. If an At-211 radiopharmaceutical is to be developed for clinical application, it will be necessary to develop a production process in which small controlled volumes of At-211, in specified chemical forms, can be produced more reliably and consistently. Preferably, such a process would be readily controllable to produce desirable small volumes of selected activities in a solution of solvents that is compatible with preselected radiopharmaceutical procedures in which the activities are to be used. More specifically, it would be desirable to have such a process in which a choice of solvents can be effectively used in the production of a desired At-211 radiopharmaceutical.

OBJECTS OF THE INVENTION

A major object of the invention is to provide a process for reliably and consistently producing an At-211 radiopharmaceutical in a desirably small controllable volume.

Another object of the invention is to produce an At-211 radiopharmaceutical by a process that includes the option of eluting At-211 with a choice of solvents, any of which are compatible with subsequently desired radiopharmaceutical procedures in which the At-211 radiopharmaceutical is to be utilized.

A further object of the invention is to provide a process for reliably producing an At-211 radiopharmaceutical in the chemical form as Astatide and in a desirably small controlled volume.

Still another object of the invention is to provide a process that utilizes a novel one-step distillation and collection procedure for producing At-211.

Yet another object of the invention is to provide a process for isolation of At-211 by distilling it from a heated bismuth target that has been irradiated with alpha particles, collecting the vapor condensate in a silica gel, and eluting At-211 from the silica gel with a controllable volume of eluent that contains a solvent, which is preselected to be compatible with a given radiopharmaceutical procedure in which the At-211 is to be used.

A still further object of the invention is to provide a process for isolating At-211 from a Bismuth target without requiring the use of other chemicals, which frequently are a source of contaminants, thereby to avoid the introduction of contaminants into the isolated At-211.

Another object of the invention is to provide a process for isolating At-211, wherein the vaporization of bismuth from a target is suppressed by using a selected choice of dry carrier gases, which is effective to prevent Bi metal from contaminating the At-211 isolated by the process.

Additional objects and advantages of the invention will become apparent to those skilled in the art from the description of it presented herein, considered in conjunction with the accompanying drawings.

SUMMARY OF THE INVENTION

In one preferred arrangement of the invention a At-211 radiopharmaceutical is produced by a process in which a target of irradiated bismuth is heated within a critical range of temperatures, for a predetermined period of time, in a suitable still, while passing a dry carrier gas through the still to carry At-211 vapor evolved from the Bi target to a condenser which has a condensate collector that is effective to remove essentially all of the At-211 from the carrier gas. Subsequently, as a safety precaution, the carrier gas is passed through a series of filters to remove remaining traces of the At-211 from it. A small controlled volume of eluent, which is preselected from a choice of solvents, is used to elute At-211 from the condensate collector. Finally, the controlled volume of eluent containing the At-211 is eluted from the condensate collector and held for use in a selected radiopharmaceutical procedure.

DESCRIPTION OF THE PREFERRED EMBODIMENTS

A preferred sequence for practicing the process for producing Astatine-211 (At-211), according to the invention, includes the following steps. First, a suitable target of alpha-particle irradiated bismuth is provided, coated to a predetermined thickness on a suitable thermally conductive backing member. Next, a vapor-producing still is provided, operably connected with a condenser that has a condensate collector therein. Finally, an effluent gas filter is provided, which is operably connected to receive effluent gas from the condenser when it is operated according to the preferred process of the invention. A more detailed description of certain novel preferred embodiments of apparatus useful in practicing the process of the invention is given below. Also, desired arrangements of these various pieces of apparatus, as best used in the preferred process of the invention, will be more fully explained later.

Another characterizing step in the preferred process of the invention is to heat the target of irradiated bismuth in the still, at a suitable temperature, and for a predetermined period of time that is sufficient to evolve At-211 vapor from the target. In practicing the process of the invention it has been found that such a suitable temperature is in the range of about 630° to 680° C., and that the predetermined heating time period should be in the range of 50 to 80 minutes. Most preferably, the target is heated at about 650° C. for one hour in practicing the process of the invention. In order to carry the At-211 vapor from the still to the condenser that is connected in series with the still, in a suitable manner, such as that more fully explained below, a dry carrier gas is provided, and suitable gas conduit means are arranged with the still for passing the carrier gas through the still and the condenser. Effluent carrier gas leaving the condenser is routed through an effluent filter that is disposed in a suitable further conduit means, which is connected to the output of the condenser, in a suitable manner explained more fully in conjunction with the description of a preferred apparatus used in practicing the process, as described below.

After the target-heating and distillation step of the process is completed, a suitably controlled small volume of eluent is used for eluting At-211 from the condensate collector. The eluent is selected from a desired range of solvents to be compatible with a given desired radiopharmaceutical procedure in which the At-211 activity is to be used. The concluding step of the process is to collect the At-211 in the small controlled volume of eluent, so it is ready for use in the given desired radiopharmaceutical procedure.

Figure 2:
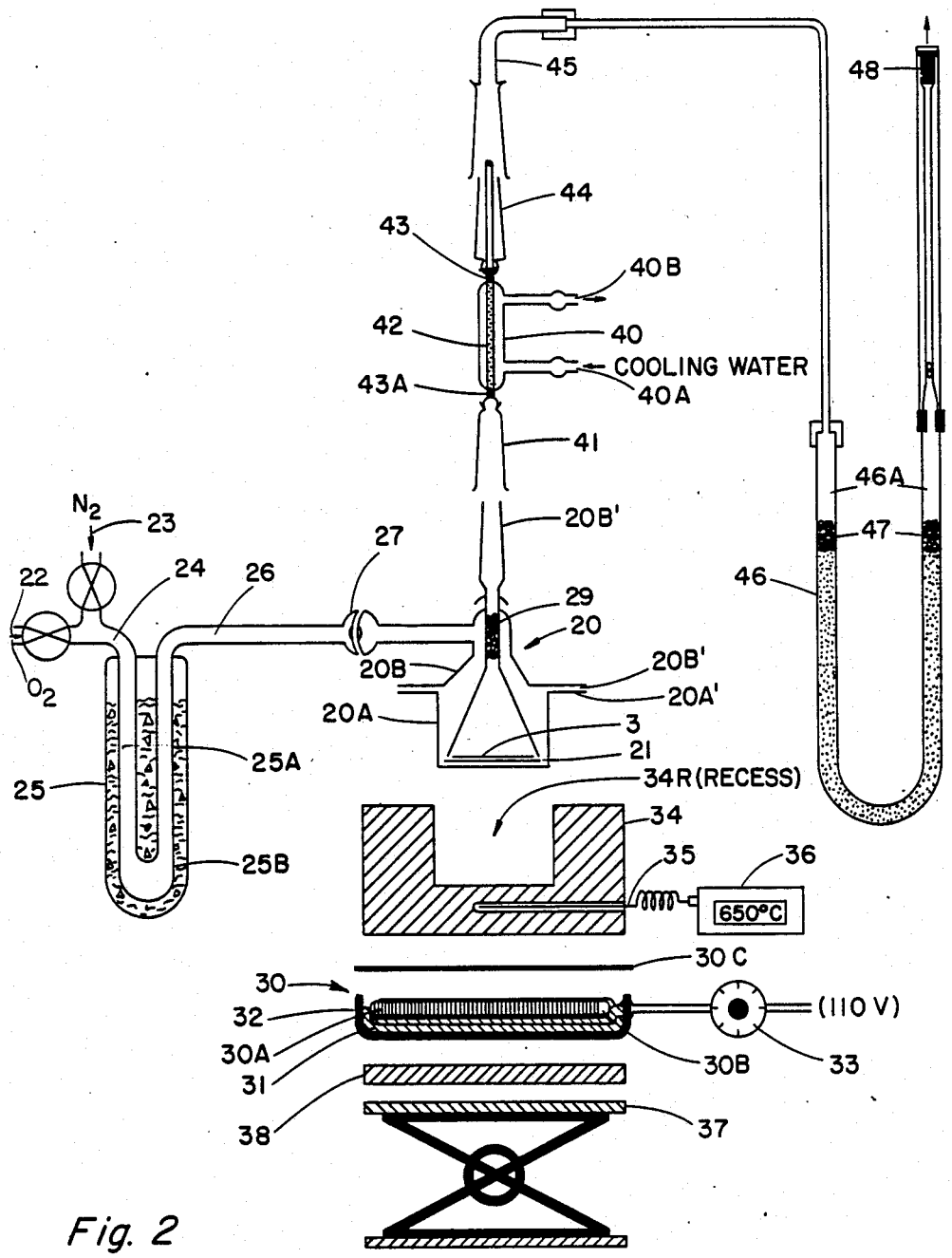
FIG. 2 is a schematic illustration of a novel one-step distillation and collection apparatus assembled in a system that is useful in the elution of At-211 with a choice of solvents, one of which is used in a small controlled volume, as desired for application of the activities produced in subsequent radiopharmaceutical procedures. The distillation and collecting apparatus is shown in combination with; apparatus for applying a dry carrier gas to the system, a furnace for applying heat to the distillation apparatus, and means for filtering the effluent carrier gas before it is discharged from the system.

In addition to the basic preferred process steps described above, in the best mode of practicing the process of the invention, a gas dryer apparatus is provided comprising a suitable conventional trap that is kept at about −50° C. by means of a mixture of dry ice and isopropyl alcohol, or other conventional coolant. A carrier gas mixture of about 50% oxygen ($O_2$) and 50% nitrogen ($N_2$) is provided through suitable conventionally valved conduit means, from sources (not shown), and is passed through the gas dryer apparatus that is immersed in the dry ice and isopropyl alcohol mixture, as shown in FIG. 2, before the carrier gas is passed through the heated still in the process steps explained above. It will be recognized that other suitable means may be used for drying the carrier gas, and other suitable carrier gases, such as various mixtures of oxygen with nitrogen, argon, helium or other gases, can be used in practicing other arrangements of the process of the invention.

Similarly, it will be understood that in selecting the predetermined solvents to be used in eluting At-211 from the condensate collector of the condenser a number of different solvents can be used successfully. We have found in practicing the process that a solution comprising 0.5M NaOH and 0.1M $NaHSO_3$, used in a controlled volume of eluent that is in the range of about 0.45 to 0.65 milliliters, is effective to elute about 90% of the At-211 activity from the condensate collector, responsive to being passed through the collector only once. Accordingly, in the preferred practice of the invention only one portion of the eluent is used to elute the desired At-211 fraction from the condensate collector. In a modification of the most preferred process, such a solution of eluent was divided into a first portion and a second portion of about equal volumes (each portion being about 0.6 ml), and it was found that the first portion was effective to elute about 90% of the At-211 from the collector, while the second portion eluted a further 8% of the At-211 from the condenser. In still further tests, when additional portions of the same eluent, in about equal size volumes, were passed through the condensate collector it was found that less than 1% more of the At-211 activity was eluted from the collector with the third portion of eluent, and application of a fourth portion of eluent only removed additional traces of the At-211. Thus, it can be seen that in practicing the process of the invention with only two portions of eluent being used, about 98% of the At-211 condensed in the condensate collector can be eluted from it.

Now that the general operation of the process of the invention for isolating At-211 has been described, it will help to again mention the filtering function of the apparatus shown in FIG. 2. As mentioned earlier, in order to prevent the traces of At-211 that are not isolated in the condensate collector from being undesirably discharged from the system and into the atmosphere, while the carrier gas is being used in the process as described above, effluent gas confining conduit means are connected to the output of the condenser. A suitable effluent filter is provided in that conduit means, in a suitable conventional trap arrangement, that is effective to extract any traces of At-211 from the effluent carrier gas that passes from the condenser and into the effluent filter. In the preferred embodiment of the process of the invention, porous charcoal is mounted as the effluent filter in a generally U-shaped, tubular trap through which the effluent carrier gas is passed after leaving the condenser. It will be recognized that the effluent gas filtering means, shown in FIG. 2 down stream from the condensate collector, are not an essential part of the At-211 isolating process, but rather are provided as a safety measure to prevent traces of At-211 from entering the atmosphere.

In the most preferred arrangement of the process of the invention, the target of irradiated bismuth is made by first providing an aluminum backing member and forming a generally circular depression in a surface of it, for containing and confining molten bismuth. Instead of using aluminum, any thermally conductive material that can be suitably wetted with Bi can be used to make the backing member. The aluminum backing member is then heated to above the melting temperature of bismuth, i.e., to about 300° C. and shavings or other suitable particles of very high purity Bi, i.e. at least 99.999 percent pure Bi, is placed in the depression formed on the surface of the heated aluminum member, in order to melt the bismuth particles. The very high purity Bi is desirable, in the preferred practice of the invention, to reduce the co-production of Po-211, which seriously interferes with radiopharmaceutical quality of the At-211 isolated by the process, as well as increasing the problems associated with radioactive waste disposal. It will be understood that the basic process of the invention can be practiced with reagent grade Bi, recognizing the foregoing problems will be encountered and should be appropriately dealt with.

After the bismuth is melted, the surface of the depression on the aluminum is scratched to facilitate the wetting and uniform distribution of that surface by the molten bismuth. Subsequently, the aluminum member is cooled and the bismuth coating is machined to a smooth surface in order to form the bismuth coating in a layer of generally uniform thickness that has about 100 milligrams of bismuth per square centimeter of coated backing member area, in order to make full use of the beam of irradiating alpha particles that will be applied to it. It will be understood that the process will not be rendered inoperable if a thinner coating of Bi is used, but the yields of At-211 activity on the target will be lowered by using thinner Bi coatings.

Next, the target is mounted in operating relationship to receive accelerated alpha particles from a cyclotron, or from other suitable conventional particle accelerating apparatus, in order to irradiate the target for a time period in the range of 1 to 4 hours with a beam of accelerated alpha particles having a current intensity or beam flux, in the range of 6 to 10 microamperes. In performing the irradiating step of the process, we have found that a suitable target is formed when it is irradiated with a 26.5±0.5 MeV accelerating voltage alpha particle bombardment. A further desirable process step used in irradiating the target is to cool the coating of bismuth on the target by passing a flow of helium gas, at about one atmosphere pressure, over the machined surface of the bismuth target while it is being irradiated by alpha particles from the cyclotron, or other suitable accelerators.

Figure 1:
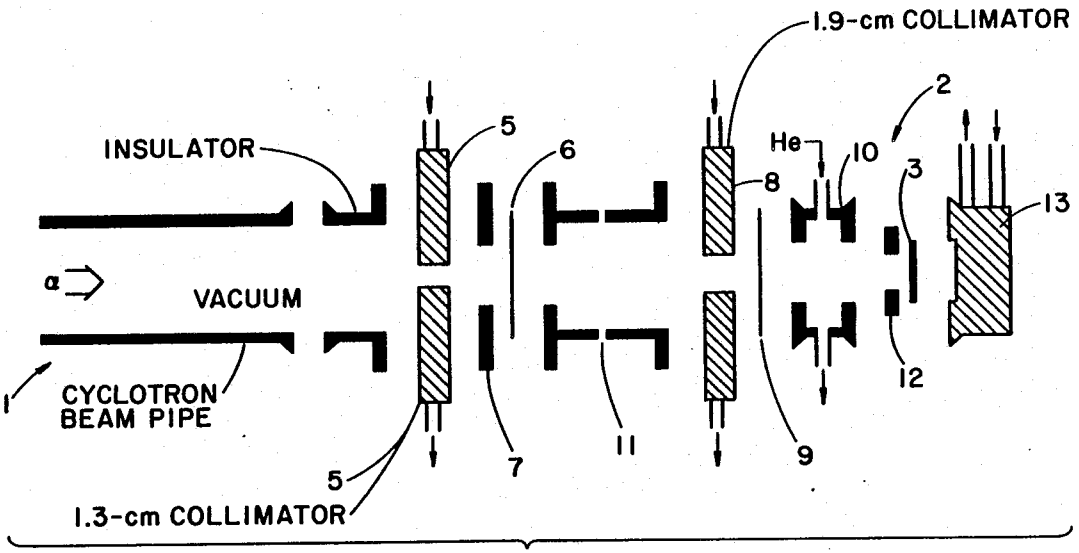
FIG. 1 is a schematic side plan view, partly in cross section, of a bismuth target assembly, which is used in practicing the preferred process of the invention. The target assembly is illustrated in combination with a cyclotron output particle beam pipe and with collimators and cooling systems for controlling the movement and application of alpha particles from the cyclotron, as those particles bombard the bismuth target in the target assembly.
Figure 1A:
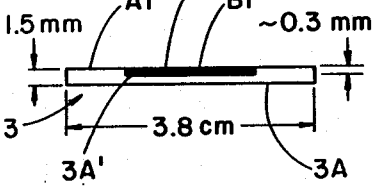
FIG. 1A is a side plan view of a target assembly comprising an aluminum backing member 3A and having a broken away portion to illustrate a Bismuth filling or coating in a depression 3A' formed in the backing member.

Now that a preferred sequence of the process steps of the invention has been described, along with some modifications that optimize the process for certain applications, reference is be made to FIGS. 1 and 2 of the drawings, in connection with a description of a unique preferred apparatus that is arranged in a suitable distillation and collection system for practicing the process of the invention. There is illustrated in FIG. 1, mounted in operative relationship to the output beam pipe 1 of an accelerator, such as a cyclotron, a target assembly 2, which includes a target 3 comprising a bismuth coating mounted on a suitably shaped aluminum disk, in a manner that will be more fully described. As background for that description, reference is first made to FIG. 1A to more fully explain the preferred form of the target, which the applicants used in practicing the best mode of the process of the invention. As shown, the target 3 depicted in FIG. 1A comprises an aluminum backing member 3A having a depression 3A' formed in one of its major surfaces. The depression is approximately 0.3 millimeters in depth and is formed as a circular pattern on the upper surface of the backing member. The aluminum backing member is made about 1.5 millimeters thick and is about 3.8 centimeters in diameter in order to suitably cooperate with the other elements of the target assembly 3. Of course, other suitable dimensions for the target 3 can be used in making other embodiments of a target for use in different applications. The bismuth coating 4 that is melted into the depression 3A', after the aluminum backing member 3A is suitably heated, as explained above, has its upper or outer surface machined to a smooth finish after the molten bismuth coating has cooled sufficiently to enable such machining.

Referring again to FIG. 1, it can be seen that the target assembly 2 includes an isolated water-cooled 1.3 centimeter collimater 5, that is directly connected to the output of the cyclotron beampipe 1, and that has a suitable foil 6, such as a foil of Dural metal, mounted in spaced relation to it with a suitable apertured insulator 7 positioned between the collimater 5 and the Dural foil 6. A second water-cooled collimater 8, which has a 1.9 centimeter aperture, is used to conduct heat from an aluminum absorber 9. The absorber 9 is used as a degrader of alpha particle energy, of about 45 to about 27 MeV, and is positioned between the 1.9 centimeter collimater and a helium cooled chamber 10. As can be seen, the assembly 2 also includes a larger chamber 11, positioned between the Dural foil 6 and the 1.9 centimeter collimater 8. An annular collar 12 is secured to the target 3 to hold it tightly in place in its operative position, for bombardment with alpha particle the assembly 2. Helium gas from a suitable source (not shown) is passed by associated conduit means through the chamber 10 and over the face of the bismuth coating 4 on the target 3 (also see FIG. 1A), while the target is being irradiated with alpha particles from the cyclotron beampipe 1. A combined Faraday cup and target holder 13, which is also water cooled, completes the target assembly 2.

It should be understood that a suitable source of cooling water (not shown) is connected by conduit means to the two collimaters 5 and 8 and to the combined Faraday cup and target holder 13 to cool these members when the target 3 is being irradiated. The arrows in FIG. 1, next to these components (5, 8 and 13) indicate the flow of such a coolant. By separating the aluminum absorber 9 from the target 3, two advantages are realized. First, the heat generated by the absorber is conducted by the 1.9 cm collimater 8 from the assembly rather than being applied to the target 3. Second, as the beam of alpha particles from the cyclotron straggles through the aluminum absorber 9, the beam is further defocused and thus prevents the formation of hot spots on the bismuth coating 4 of target 3. As noted above, in making a suitable target 3, for practicing the process of the invention, an assembly such as the target assembly 2 shown in FIG. 1 is irradiated by alpha particles from a suitable source, such as the 60 inch cyclotron that is in operation at Brookhaven National Laboratory. Of course, other suitable alpha particle accelerators or accelerating means can be used to achieve the desired irradiation of a target for use in practicing the process of the invention.

In order to best practice the novel one-step distillation and astatine-211 collection procedure of the process of the invention, the novel apparatus shown in FIG. 2 was developed and assembled into the illustrated systems. This novel apparatus comprises a two-part still 20 which includes a quartz glass, generally cylindrically shaped lower part 20A and a quartz glass, partially conically shaped, upper part 20B. The parts (20A, 20B) are provided with smooth ground surfaces 20A', and 20B' at their respective abutting peripheries, to provide a joint that allows for expansion of the heated lower part 20A, relative to the upper part 20B, as the still is heated. In operation, the two parts 20A and 20B of the still are clamped together with suitable conventional ball-joint clamps (not shown), or by other suitable means. The irradiated Bi target 3 is mounted within the still 20 by placing it on a thin disk of quartz 21, which is effective to prevent the aluminum of the target 3 from attacking the glass of the bottom part of still 20A. The risk of having the still 20 cracked by such an attack is thus avoided.

Suitable conventional sources of oxygen and nitrogen (not shown in detail), as indicated by the arrows 22 and 23 are fed through a suitable conduit 24 into a glass trap 25, which is immersed in a mixture of dry ice particles 25A and a solution of isopropyl alcohol 25B to maintain a temperature of approximately −50° C. in the trap 25. That temperature is effective to condense moisture from, and thus dry, the carrier gas before it is passed, into discharge tube 26, that is connected through a suitable conventional connector means 27, to an inlet tube integral with the upper portion 20B of the still 20. It will be recognized that various desirable mixtures of oxygen 22 and nitrogen 23 can thus be used to supply the desired carrier gas to the still 20 in this arrangement of the apparatus used in practicing the process of the invention. The $O_2$ concentration in the carrier gas should be sufficient to result in formation of $BiO_2$, such that Bi metal does not vaporize along with the At-211. As explained above, in the preferred process of the invention a mixture of 50% oxygen and 50% nitrogen is used as the dry carrier gas in practicing the most preferred steps of the process of the invention.

To suitably heat the still 20 for its use in the process, various furnace arrangements can be used. However, the applicants found that commercially available glove boxes are limited in volume to about ½ cubic meter, so if they were to be used with commercially available hot plates, which are generally relatively high powered, the hot plates would cause the inside temperature of such glove boxes to exceed safe limits. In that respect, it should be understood that, due to the biological activity of Astatine, the desired distillation procedure used in practicing the disclosed process must be carried out in an enclosure similar to a glove box. To overcome these problems, a small furnace 30 was constructed, with about 300 centimeters of Nichrome wire 30A wrapped around a spiral shaped quartz rod 30B. The Nichrome wire was made of 80% nickel and about 20% chromium, and was 24 gauge, having about $1.5\times10^{-4}$ ohms per centimeter resistance. The Nichrome wire filament 30A was immersed in an asbestos compound 31 disposed in a shallow quartz dish 32. A suitable conventional Variac 33 was connected in a well known manner to a suitable source of 110 volt electric power (not shown in detail), to accurately control the temperature generated by the furnace 30. A quartz disk cover 30C was positioned over the quartz dish 32 to support a suitable stainless steel heating block 34 that has a chromium-aluminum thermocouple 35 mounted within it, as shown. The thermocouple is connected to a suitable conventional temperature indicating means 36, which enables an operator to accurately measure and control the temperature of the still 20 by suitably adjusting the furnace Variac 33.

For convenience, the furnace 30 was mounted on an adjustable table 37, which was covered by a suitable insulator plate 38 that protects it from the heat of the furnace. It will be understood that in operation of the distillation step of the subject process, the lower part 20A of the still 20 should be positioned within the recess 34R formed in the heat block 34.

Returning now to the description of the distillation and collection apparatus shown in FIG. 2, there is illustrated a quartz glass condenser 40, which in this preferred form is a column condenser. About a 2 millimeter inside diameter is provided in the column of condenser 40, and it has a cooling water inlet port 40A and outlet port 40B, which are operably connected to a suitable source of water and associated water discharge means (neither are shown, except by the depicted arrows). Condenser 40 is coupled in operating relationship to the still 20 by a suitably formed quartz glass connector tube 41, which has ground surfaces at its opposite ends to form fluid tight seals with the upper end of the discharge port 20B' of the still, as well as with the lower inlet port of the column condenser 40, respectively. A suitable condensate collector 42 is positioned within the column condenser. In a preferred form the condensate collector 42 comprises silica gel in the form of a 60 to 100 mesh (up to 200 mesh has also been found suitable) that is commercially available. The silica gel mesh is washed with concentrated nitric acid, then flushed with triple distilled water and dried at 110° C., before it is used in the process of the invention. The condensate collector 42 is held in position within the condenser 40 by pads of quartz wool 43 and 43A, which are, respectively, mounted adjacent to the inlet and outlet ports of condenser 40. Similarly, another pad of quartz wool 29 is positioned in the neck of the port 20B' of still 20, as shown in FIG. 2. This works as a filter to remove any Bi target metal which may be volatized by the still. A second commercially available connection tube 44, having ground inlet and outlet surfaces for effecting fluid type seals, respectively, with the outlet end of condenser 40 and the inlet end of an effluent discharge conduit means 45, is positioned in the system, in the location shown, to connect the condenser 40 to the effluent gas discharge conduit means.

In order to ensure complete removal of essentially all astatine radio activity from the carrier gas effluent leaving the condenser 40, an effluent filter 46, which in the preferred apparatus used in the system shown in FIG. 2 comprises a body of porous charcoal mounted in a generally U-shaped tubular quartz glass trap 46A, is connected to the effluent discharge conduit means 45. Pads of glass wool 47, or other suitable filter material, are used to hold the particles of porous charcoal in position within the trap 46A. Finally, an absolute filter 48 of suitable conventional design, is positioned in the discharge port connected to the end of the trap 46A, as shown, to further assure the removal of all astatine activity from the effluent gas that is discharged from the system. It will be recognized that other effluent gas filtering arrangements can be used, but we have found that only a small fraction, i.e. substantially less that 1%, of the astatine activity escapes from the silica gel condensate collector 42 with the apparatus shown in FIG. 2; thus, the charcoal filter 46 and absolute filter 48 have proven effective to assure essentially the complete removal of all remaining astatine activity from the effluent discharge. As pointed out above, the filters 46 and 48 are not necessary to the effective practice of the invention. Those filters are used in the disclosed embodiment, only as a safety precaution.

In using the apparatus shown in FIG. 2 to practice the preferred process of the invention, all of the quartz glassware components, including the still 20 and column condenser 40, are preferably washed with hot nitric acid, then with chromic acid, then with distilled and redistilled water, and are then dried for several hours by baking them at about 110° C. The component parts of the apparatus are then assembled into the system shown in FIG. 2 and are preferably baked in that assembled state at about 660° C. for 8 to 12 hours. During a portion of that latter baking period, the target 3 is being suitably irradiated by being operably mounted, as explained above, to be bombarded with alpha particles from a suitable accelerator, such as a cyclotron. About two hours before the scheduled end of the irradiation step, the assembled apparatus shown in FIG. 2 is removed from the baking furnace and allowed to cool to room temperature. Next, cooling water is connected to the ports 40A and 40B of the condenser 40, and the irradiated target 3 is placed on the quartz disk 21 within the still 20. The still parts 20A and 20B are clamped together and Nitrogen gas 23 is then passed through the apparatus to flush the system. The ratio of oxygen to nitrogen in the dry gas supply is then adjusted to about 50% oxygen and 50% nitrogen, using the conventional needle valves shown schematically down stream from the inlet gas-indicating arrows (but not numbered) in FIG. 2. Next, the Variac 33 is then adjusted to bring the furnace 30 up to a desired temperature within the range of 630° to 680° C. In several production runs with the process, excellent production of At-211 was attained when the furnace was maintained at about 650° C. during the distillation procedure.

After the furnace has operated for about 1 to 4 hours to effect the desired distillation of At-211 from the target 3, the furnace 30 is turned off and removed so that the still 20 can cool down for about 10 minutes. The cooling water to the condenser 40 is turned off and the supplies of carrier gas 22 and 23 are also turned off. Subsequently, the column condenser 40 is removed from its connection with the connector tubes 41 and 44 and a controlled small volume, such as about 0.5 milliliters, of eluent containing a choice of predetermined solvents, such as the solution of 0.5M NaOH and 0.1M $NaHSO_3$, described above, is used to elute about 90% of the At-211 activity from the silica gel condensate collector 42.

Figure 3:
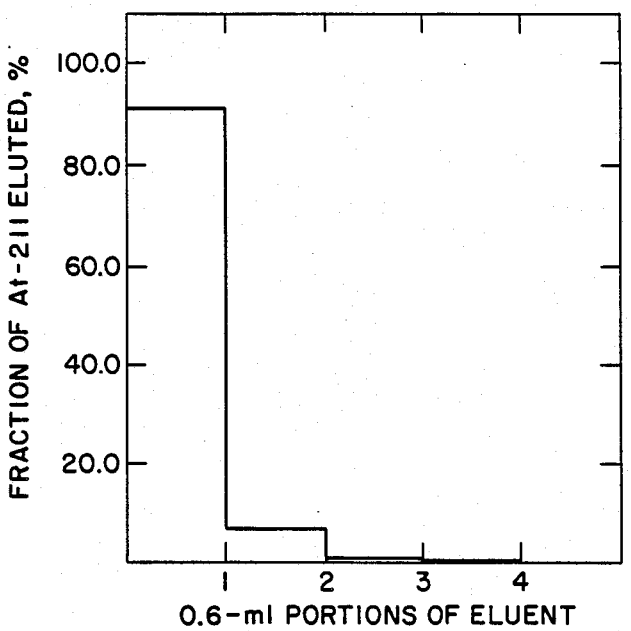
FIG. 3 is an elution curve showing the percentages of At-211 activity that is eluted from a condensate collector with successively applied portions of a chosen eluent, according to the preferred process of the invention.

FIG. 3 shows a typical elution curve for At-211 activity, as achieved in practicing the process of invention. From the curve shown in FIG. 3, it can be seen that about 90% of the At-211 activity is eluted with the application of a first portion of about 0.6 milliliters of eluent when it is passed through the condensate collector 42. When a second, approximately equal controlled volume of eluent is passed through the condensate collector, it is seen that an additional approximately 8% of the astatine activity is eluted from the collector. Finally, when successive third and fourth portions of about equal controlled volumes of eluent are passed through the condensate collector, about an additional 1% of the activity is removed with the third portion and only a trace of remaining activity is removed with the fourth portion of eluent.

Figure 4:
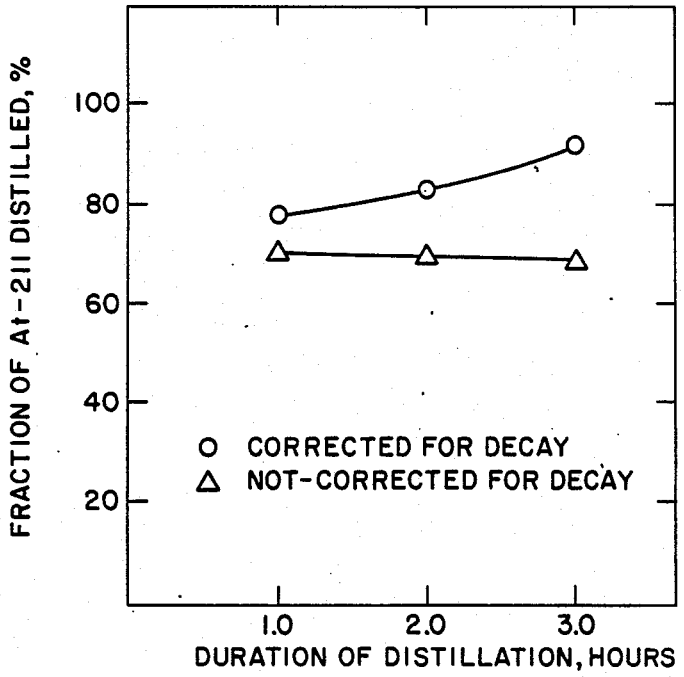
FIG. 4 is a graph showing the effect of variations in the duration of the distillation step used in practicing the preferred process of the invention, as such variations alter recovery of At-211 by the process.

The effect of variations in the duration of the distillation step of the process of the invention, i.e., as it effects recovery of At-211, is shown in FIG. 4. Curve A in FIG. 4 shows that about 80% of the astatine activities are distilled in the first hour of operation of the heated still 20, when the still is heated to a temperature in the range of 630° to 670° C. Further, it is seen that after the first hour, the rate of distillation increases slowly with time but, due to the decay of At-211, which has a half life of 7.21 hours, the overall yield actually decreases with time, as shown by curve B in FIG. 4. Thus, it will be recognized that in a preferred distillation procedure for the process of the invention the distillation step is effected in approximately one hour, although longer distillation periods, e.g. up to three hours have been used with only minor loss in overall yield, as indicated by the curve B in FIG. 4.

SAMPLE RESULTS

Numerous production runs with the process of the invention have been conducted by the applicants to determine the effects of variations in target irradiation dosages on the percentage recoveries of At-211 that are achievable with it. The following Table I summarizes data from ten of those runs. In conducting those runs the 60 inch cyclotron at Brookhaven National Laboratory was used as the source of alpha particle irradiation for an aluminum-backed Bi target in which the Bi coating was about 1.0 millimeter thick and was manufactured according to the preferred process steps described above. An acceleration voltage of 44 MeV at the extraction beam pipe of the cyclotron was maintained on the irradiating beam. An aluminum absorber (as shown in FIG. 1), averaging 110.4 mg/cm$^2$, was used in the target assembly, mounted in series with a 1.25 mil thick Dural metal foil, in the manner explained above in connection with the preferred target assembly irradiation process steps. The aluminum absorber is effective to degrade the incident beam energy from about 44 MeV to about 26.5±0.5 MeV. Similarly, the distillation temperature and duration, as well as the dry carrier gas (50/50 mixture of $O_2$ and $N_2$), and eluent solution (0.5M NaOH and 0.1M $NaHSO_3$) gas used, were maintained in the preferred ranges set forth in the foregoing description of the process, and a small controlled volume of eluent (0.45 to 0.65 ml) was used as a single portion application in each of the runs summarized in Table I.

TABLE I

Recovery of At-211 in Actual Production Runs

| | Irradiation Dose (μA-hr.) | Duration of Irradiation (hr.) | Average Flux I (μA) | At-211 Yield (mCi) | At-211 Saturation Yield I(μA) | At-211 Recovery (%) |
|---|---|---|---|---|---|---|
| Target Dosage Before Recovery Process | 1.001<br>1.001 | 0.1396<br>0.1401 | 7.17<br>7.15 | 0.422<br>0.412 | 4.42<br>4.31<br>4.37 (avg.) | 100 |
| Processed Targets Run No. | | | | | | |
| 1 | 31.7 | 3.5 | 9.1 | 4.56 | 1.8 | 41 |
| 2 | 10.0 | 1.3 | 7.9 | 2.80 | 3.1 | 71 |
| 3 | 10.9 | 1.6 | 6.7 | 2.60 | 2.7 | 62 |
| 4 | 29.0 | 3.0 | 9.7 | 5.86 | 2.4 | 55 |
| 5 | 24.5 | 3.2 | 7.6 | 4.59 | 2.3 | 53 |
| 6 | 14.5 | 1.8 | 8.2 | 3.15 | 2.4 | 55 |
| 7 | 27.0 | 2.9 | 9.3 | 5.00 | 2.2 | 50 |
| 8 | 36.7 | 3.9 | 9.4 | 7.14 | 2.4 | 55 |
| 9 | 28.0 | 3.0 | 9.2 | 4.82 | 2.1 | 48 |
| 10 | 38.0 | 3.95 | 9.6 | 8.91 | 2.9 | 66 |
| | | | | | Avg. 56 ± 13 | |

In Table I it should be understood that the top two horizontal lines of data (shown above the double line and below the column headings) relate to the target dosage before the target was used in the process runs (1–10) listed in the lower portion of the Table. An average saturation yield of At-211/per I(μAmp) for two such runs was used as a 100% value for At-211 recovery. As shown by the column headings, the irradiation doses in microampere-hours, (Col. 2) equals the product of the values shown for the duration of irradiation (Col. 3) and the average irradiation current or flux density (Col. 4). The At-211 activity yields, measured in millicuries for the respective runs, is shown in the fifth column. Col. 6 shows the quotient obtained by dividing the Astatine saturation yield for each target by the related average flux (I, Col. 4) for each run. Finally, the seventh column shows the percentage recoveries of At-211 realized from the respective runs, using the average target dosage value 4.37, shown above the double line at the top of Col. 6. Thus, the respective recovery percentages shown in Col. 7 are determined by dividing the Col. 6 figure, in each run, by 4.37.

The production data for the process runs summarized in Table I show that the process of the invention was proven effective to recover an average of 56%±13% (bottom of Col. 7) At-211 for those runs. This high level of recovery is believed to constitute a substantial improvement over any other practical known process for producing At-211 in small controlled, readily usable, volumes. An important feature of the process of the invention is that its practice does not require the use of any other chemicals in order to isolate the desired At-211, thus, the risk of introducing contaminants such as those frequently present in other chemicals, is completely avoided.

It will be apparent that in light of the teaching of the invention disclosed herein various modifications and further alternative sequences of the disclosed process steps can be readily developed by those skilled in the art. Accordingly, it is out intention to encompass the true limits and scope of the invention within the following claim.

We claim:

1. A one-step chemical manipulation in combination with a distillation and collection process for producing At-211 comprising;

a. providing a target of irradiated Bismuth coated to a predetermined thickness of a backing member, b. providing a vapor-producing still operably connected with a condenser that has a water cooled condensate collector formed of a dry silica gel mesh therein maintained at a temperature above the freezing point of water, and providing an effluent gas filter that is operably connected to receive effluent gas from the condenser, c. heating the target in said still at a temperature in the range of about 630°–680° C. for a time period in the range of 50 to 80 minutes, to evole At-211 vapor from said target, d. providing a dry carrier gas having an oxygen concentration that is sufficient to form $Bi_2O_3$ thereby to essentially preclude vaporization of Bi metal, passing said carrier gas through said still to carry the At-211 vapor to said condenser, and to carry effluent from the condenser to the effluent gas filter, e. eluting At-211 from the condensate collector of said condenser with a controlled volume of eluent containing predetermined solvents that are compatible with a given desired radiopharmaceutical procedure, and f. collecting said At-211 in said controlled volume of eluent for use in said given radiopharmaceutical procedure.

2. A process as defined in claim 1 including:

a. providing a gas dryer apparatus comprising a trap cooled by a mixture of dry ice and isopropyl alcohol, b. providing a carrier gas mixture of about 50% $O_2$ and 50% $N_2$, and c. passing said carrier gas mixture through said gas dryer apparatus, to dry the gas mixture, before passing the gas mixture through said still.

3. A process as defined in claim 1 wherein said controlled volume of eluent is effective to elute about 90% of the At-211 from the condensate collector responsive to being passed through the collector only once.

4. A process as defined in claim 3 wherein said controlled volume of eluent includes a first portion and a second portion, said first and second portions being about equal in volume, and said second portion being effective to elute about 8% of the original amount of At-211 collected in the condenser, after said first portion has effectively eluted about 90% of said original amount of At-211 from the condenser.

5. A process as defined in claim 1 including making said target of Bi coated on an aluminum backing member, by the steps comprising;

a. providing an aluminum backing member, forming a depression in a surface of said member, heating the member to above the melting temperature of Bi, b. placing particles of high purity Bi in the depression in said heated Al member to melt the Bi, and scratching the surface of the depression to help the Bi wet and uniformly coat that surface, cooling the backing member, c. and machining the Bi coating to a smooth outer surface, thereby to form the Bi coating in a layer of generally uniform thickness having about 100 mg of Bi per $cm^2$ of coated backing member area, and d. irradiating the target for a time period in the range of 1 to 3 hours with a beam of $26.5 \pm 0.5$ MeV accelerating voltage accelerated alpha particles having a current in the range of 6 to 10 microamperes.

* * * * *